United States Patent [19]

Davidson

[11] 4,235,367

[45] Nov. 25, 1980

[54] SECONDARY CENTRIFUGE TUBE SEAL

[75] Inventor: Howard R. Davidson, Palo Alto, Calif.

[73] Assignee: Beckman Instruments, Inc., Fullerton, Calif.

[21] Appl. No.: 49,389

[22] Filed: Jun. 18, 1979

[51] Int. Cl.[3] ..... B04B 15/00

[52] U.S. Cl. ..... 233/26; 233/1 A

[58] Field of Search ..... 233/26, 1 A, 27, 1 R; 210/DIG. 23, DIG. 24; 285/52, 54; 277/206 R

[56] References Cited

U.S. PATENT DOCUMENTS

| | | | |
|---|---|---|---|
| 2,878,992 | 3/1959 | Pickels | 233/11 |
| 3,447,712 | 6/1969 | Galasso | 220/3 |
| 3,938,735 | 2/1976 | Wright | 233/26 |
| 4,076,170 | 2/1978 | Chulay | 233/26 |
| 4,080,175 | 3/1978 | Chulay | 233/26 |
| 4,087,043 | 5/1978 | Anderson | 233/26 |

*Primary Examiner*—Robert W. Jenkins

*Attorney, Agent, or Firm*—R. J. Steinmeyer; F. L. Mehlhoff; William H. May

[57] ABSTRACT

A secondary seal arrangement for use in a rotor to ensure the retention of the fluid sample within the test tube cavity of the rotor during high speed centrifugation in an ultracentrifuge. The secondary seal arrangement acts in cooperation with both a spacer member over the centrifuge tube and a sealing plug for the rotor cavity to provide a seal of the cavity over the test tube to reduce the possibility of escape of any fluid which may inadvertently exit the centrifuge tube itself. The secondary seal is positioned within the rotor tube cavity above the capping seal for the centrifuge tube to provide a closure of the rotor tube cavity above the centrifuge tube.

6 Claims, 2 Drawing Figures

SECONDARY CENTRIFUGE TUBE SEAL

BACKGROUND OF THE INVENTION

The present invention relates generally to sealing a centrifuge tube within a centrifuge rotor and, more particularly, is related to sealing arrangements used for sealing the rotor tube cavity in which the centrifuge tube resides.

Analytical and comparative centrifuges are commonly provided with a rotor having a series of cavities which are arranged in a generally circular orientation for receipt of centrifuge tubes carrying a sample to be centrifugated. In many prior art rotor cavity arrangements the axis of each cavity is annularly oriented with respect to the vertical rotational axis of the rotor, so that the bottom of the centrifuge tube is further away from the rotor axis than the top of the tube. An example of such an annuarly oriented rotor cavity rotor is shown in FIG. 5 of U.S. Pat. No. 2,878,992 issued to Pickels et al. on Mar. 24, 1959 and assigned to the assignee of the present invention.

During centrifugation the sample, which is initially in the lower end of the centrifuge tube, attains a somewhat vertical orientation which is essentially parallel to the rotational axis. Because the orientation of the test tube and the rotor, a portion of the sample reaches the upper end of the test tube and exerts a significant amount of loading on the capping arrangement at the upper end of the test tube. Consequently, because of the high G forces experienced by the test tube capping arrangement, it is extremely important to design a sealing arrangement on the centrifuge tube to retain the fluid sample within the centrifuge tube and reduce the possibility of escape of the fluid from the rotor which may cause a serious imbalance in the rotor, resulting in serious damage not only to the rotor but to the drive system.

Many approaches have been used to provide the necessary sealing of the upper end of the centrifuge tube in order to ensure the retention of the fluid sample within the tube during high speed centrifugation. An exemplary solution is shown in the U.S. Pat. No. 3,938,735 patent issued to Wright et al. on Feb. 17, 1976 and the U.S. Pat. No. 3,447,712 issued to M. Galasso on June 3, 1969. Both of these patents are directed to approaches for tightly sealing the upper end of the centrifuge tube to inhibit any escape of the fluid sample.

Recently, however, rotors have been designed which incorporate a series of vertical tube cavities oriented in a circular fashion around the rotational axis of the rotor. In such a configuration, the cavities are essentially parallel to the rotational axis of the rotor. The sealing of the centrifuge tube sample within the tube itself as well as within the rotor becomes extremely critical, because even a greater amount of the fluid sample will be exerting higher centrifugally induced forces on the upper end of the test tube during centrifugation than in the case of fixed angle tube rotors where the top of the test tube or centrifuge tube is closer to the rotational axis than the bottom of the tube. Since centrifuge tubes are typically made of a thin flexible material, there may be a week point which under high G loading exerted by the fluid could result in possible tube leakage, allowing the fluid to escape out of the rotor and resulting in possible damage to the rotor. Also, it is important with respect to certain biological samples, that it reduces the possibility of the sample escaping from the rotor.

One recent development in the area of vertical tube rotors has been the design of an essentially completely enclosed centrifuge tube which does not require any special or separate capping arrangement, but rather has a small fill port which is later heat sealed with integral material to provide essentially a completely enclosed tube without the use of another type of material to provide a capping arrangement. Reference is made to a copending application entitled INTEGRAL ONE PIECE CENTRIFUGE TUBE, Ser. No. 912,698, filed June 5, 1978 by Steven T. Nielsen. In any event, although a special capping arrangement is not necessary for the centrifuge tube itself, it is still important that a secondary sealing arrangement be devised to reduce the possibility of escape of the fluid sample from the rotor in the event that some defect in the tube should result in a leakage of the fluid out of the tube.

Some prior art approaches have been suggested for the creation of a secondary seal as shown in U.S. Pat. No. 4,087,043, using a channel like ring member which is designed to snap into a position around the edge of the crown member on the capping arrangement for attachment to an open ended centrifuge tube. Although this approach provides a secondary seal, its construction in conjunction with the centrifuge tube capping arrangement provides a fairly unique and distinct type of approach which is conducive to such an arrangement with the use of a capping arrangement having a crown member with a particular rim or outer edge configuration. With the use of newly designed completely enclosed centrifuge tubes the need for a separate capping arrangement with a crown member is eliminated and, therefore, a requirement exists for the use of a secondary sealing arrangement which can be constructed and utilized independent of a tube capping arrangement.

SUMMARY OF THE INVENTION

The present invention provides a secondary tube seal for incorporation in the rotor which utilizes enclosed centrifuge tubes without separate capping tube arrangements. The present secondary sealing arrangement utilizes a spacer element which is placed over the enclosed centrifuge tube and operates in conjunction with a plug member threaded into position within the centrifuge tube cavity of the rotor over the spacer member. The spacer member is designed to have a lower surface that is in conformity with the upper or top portion of the tube, so that the tube resides within the centrifuge cavity in such a position that its complete exterior surface is solidly supported. Located between the spacer member and the plug member is a sealing washer or ring. The cross-sectional shape of the sealing ring is such that it has a frustoconical surface which mates with a frustoconical or inclined surface on the top or outer portion of the spacer member. Consequently, when the plug is tightly positioned within the tube cavity, it pushes the sealing ring into a tightly wedged position between the spacer member and the cavity wall, so that any potential fluid escaping from the centrifuge tube would be prevented from seeping along the wall of the cavity by the tight engagement of the sealing ring against the cavity wall. The wedging action also forces the sealing ring against the spacer member and prevents leakage between the sealing ring and spacer member.

Because of the unique configuration of the enclosed centrifuge tube which eliminates the need for a special capping arrangement, the size of the rotor cavity necessary to accommodate the centrifuge tube can be decreased especially with respect to the upper end of the cavity which normally would accommodate the capping arrangement with a compatible plug. The present invention incorporates the use of the plug having a reduced diameter thereby also permitting the threaded opening to be of smaller diameter so that the stress concentration effect due to the threaded opening is reduced. Also, because the plug can be made smaller, this reduces the weight or mass thereof and further reduces the stress on the rotor body.

The sealing washer is designed to snap or be held tightly in place on the plug, so that there is no possibility of loss of the sealing member or incorrect installation when the plug is tightly secured in the tube cavity of the rotor.

As stated previously, the tightening of the plug into the counterbore area within the cavity will compress the annular elastomeric sealing washer and create a wedging action between the rotor body counterbore wall as well as the conical or frustoconical surface of the spacer member on which the slanted frustoconical surface of the washer mates. This wedging action between the slanting surface of the spacer member and the cavity wall will provide a positive seal that will prevent the sealing washer from creeping or moving in its position during the high speed centrifugation.

DETAILED DESCRIPTION OF THE INVENTION

Figure 1:
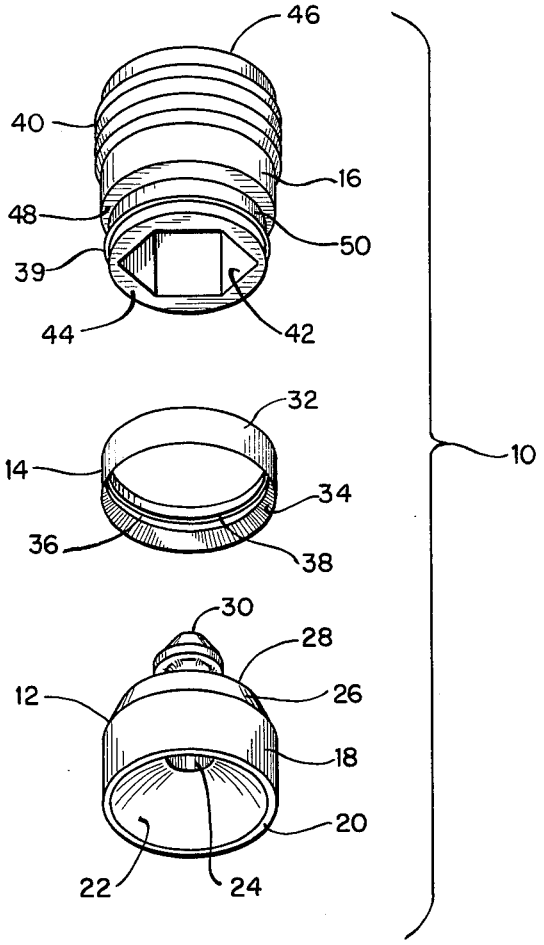
FIG. 1 is an exploded perspective view of the secondary tube seal arrangement.
Figure 2:
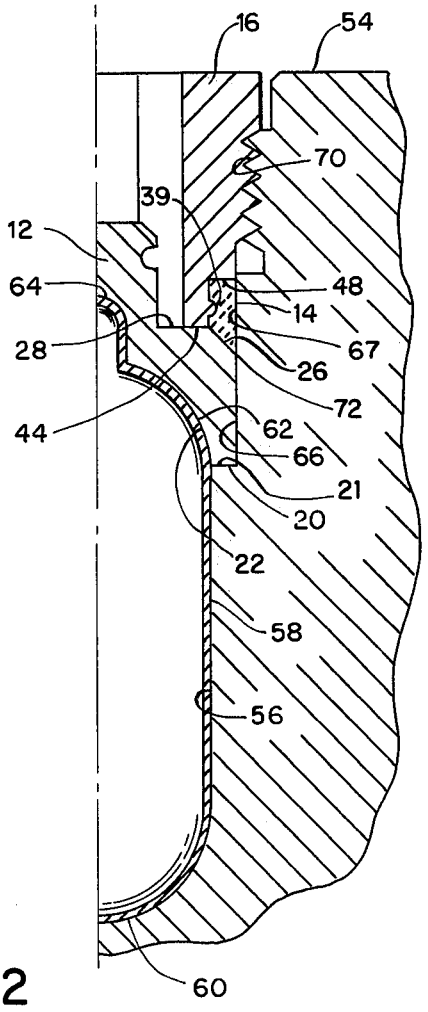
FIG. 2 is a sectional view of the secondary seal arrangement placed within a rotor over the centrifuge tube.

The secondary sealing arrangement of the present invention 10 is shown in FIG. 1 comprised of a spacer member 12, a sealing washer 14 and a plug member 16. Spacer member 12 is a generally cylindrical member having an outer cylindrical surface 18 and a bottom circular ledge 20 which is designed to contact a counterbore area or shoulder 21 in the tube cavity of the rotor as shown in FIG. 2. The bottom interior area 22 of the spacer member is hemispherical in shape and is designed to conform to the upper hemispherical shape of an essentially enclosed centrifuge tube. At the center interior bottom portion of the spacer member is a circular cavity 24 which receives a fill port seal area on the upper end of the enclosed centrifuge tube. The top outer portion of the spacer member 12 has an inclined frustoconical surface 26 which tapers from a top flat surface 28 to the side cylindrical surface 18. The center of the top flat surface 28 is a gripping projection 30 which is designed to help remove the spacer from the cavity once centrifugation has been completed.

The sealing washer 14 is preferably made of a elastomeric material and is circular in configuration. The ring has a side cylindrical surface 32. The interior bottom portion 34 of the annular washer is a frustoconical surface which slants from the bottom edge of the cylindrical surface 32 up to an inner cylindrical surface 36. Also located on the interior surface is a groove 38 which is designed to snap into place on a raised ridge 39 on the plug member 16. The frustoconical surface 34 is designed to mate with the inclined frustoconical surface 26 on the spacer member.

The plug member 16 has a plurality of threads 40 which are designed to mate with threads on the interior surface of the centrifuge tube cavity. The plug has an open area 42 in its interior which extends from the bottom 44 to its top surface 46. The interior portion 42 is shaped as a hexagonal, so that it will accommodate some type of lug wrench to allow for the tightening or loosening the plug with respect to the rotor. Adjacent the bottom surface 44 is a shoulder 48 which is designed to receive the sealing washer 14. Located on the depending surface 50 from the shoulder 48 is a raised rib 39 completely around the plug which is designed to receive the annular groove 38 of the sealing washer so that the washer is securely snapped and held into place on the plug 16.

To more completely understand the assembly of the secondary tube sealing arrangement in conjunction with the rotor and the centrifuge tube, attention is directed to FIG. 2. The rotor 54 has a tube cavity 56 into which a centrifuge tube 58 is placed. The centrifuge tube for utilization of the present invention is essentially an enclosed tube wherein its bottom portion 60 and its top portion 62 are essentially the same in configuration having a generally hemispherical shape. However, in the center of the top portion 62 is a raised neck area 64 of a considerably smaller diameter than the overall diameter of the tube which is utilized as the fill port area which is later sealed with the same material of which the tube is made, so that the tube is completely enclosed and sealed. The tube, therefore, requires no capping arrangement as typically found in many open ended tubes. Once the centrifuge tube 58 is placed within a cavity 56, the spacer member 12 is placed over the tube 58. The hemispherical interior surface 22 of the spacer is designed to be compatible with the shape of the upper end 62 of the tube 58. Therefore, the spacer 12 essentially provides in conjunction with the remainder of the tube cavity 56 complete exterior support to the tube during centrifugation, so that its deflection or deformity is kept to a minimum as a result the high speed centrifugally induced forces. As stated previously, the spacer member has a slight frustoconical surface 26 adjacent its top flat surface 28. The frustoconical surface 26 of the spacer member 12 in conjunction with the interior wall 66 of the counterbore portion of the cavity 56 creates an annular V cross-sectional shaped channel 67. It should be noted that the bottom surface 20 of the spacer member 12 is designed to rest upon the shoulder 21 of the counterbore area 66 of the tube cavity 56. Consequently, the spacer member 12 has a rigid area in which to support itself.

Once the spacer member 12 is in position over the centrifuge tube 58, the plug member 16 is threaded into engagement with the threads 70 on the interior wall of the tube cavity in the rotor. As the plug is threaded down into engagement with the threads 70, the sealing washer 14 which is in snapping engagement with the plug 16 is designed to be received within the V-shaped cross-sectional channel 67 formed between the spacer 12 and the wall 66 of the counterbore area in the rotor cavity. Once the bottom surface 44 of the plug meets the top surface 28 of the spacer member, the sealing washer 14 is compressed tightly into the V-shaped cross-sectional annular channel between the spacer member and the wall 66 of the cavity. This slanting or frustoconical shape of the bottom surface 34 of the sealing washer in conjunction with the frustoconical shape 26 on the spacer provides the wedging action which creates a very tight and secure seal over the centrifuge tube. It should be noted that the height of the cylindrical side 32 of the sealing washer has to be greater than the distance between the shoulder 48 on the plug and the bottom edge 72 of the frustoconical surface 26 where it meets the wall 66 when the plug 16 is tightly engaged with the spacer member 12. Therefore, the larger sealing washer will always be compressed or wedged within the smaller annular cavity between the spacer and cavity wall, so that it will create a tight seal against both the spacer and the tube cavity wall 66.

The tightening of the plug can be accomplished, as stated previously, by insertion of a lug wrench to accommodate whatever particular shape there is on the central interior area 42 of the plug. For purposes of illustration in the present invention a hexagonal arrangement is shown, so that a hexagonal type of lug wrench could be used to provide the tight fitting of the plug within the rotor tube cavity.

During centrifugation after the plug has been tightly secured into the rotor cavity over the centrifuge tube, sealing washer 14 will reduce the possibility of the escape of any fluid which possibly might leak from the tube 58. Without the presence of the secondary seal or the seal member 14, any fluid which might possibly leak from a potential defect in the centrifuge tube 58 could propagate up along the shoulder 21 and along the wall 66 and up through the threads 70 and 40. Therefore, as a result of the high forces generated during centrifugation, the fluid could eventually propagate through these junctures and out of the rotor. However, the tight compressive force of this uniquely designed sealing washer having a cross-sectional shape of a wedge provides a tight seal with a tight compressive force between the spacer and the cavity wall to prevent any fluid from escaping the rotor.

The present invention provides a unique and uncomplicated approach for the creation of a tight seal over the centrifuge tube.

Also, because of the design of the present annular sealing washer with its unique wedge shaped construction allows for the reduction in the diameter of the plug necessary to provide the seal. In typical prior arrangements a secondary seal requires a larger member for mounting and, therefore, creates the necessity for a larger plug over the seal. The use of a smaller plug is an advantage to the rotor to a certain extent, since the stress created by a larger plug creates possible undesirable stresses in the rotor. By the use of the present sealing arrangement in conjunction with an enclosed tube the diameter of the plug is minimized, so that it is only slightly larger in diameter than the actual centrifuge tube over which it is situated.

What is claimed is:

1. A centrifuge rotor sealing arrangement comprising:

a rotor having at least one cavity for receipt of a sample carrying centrifuge tube;

a spacer member positioned within said cavity over said tube, said tube being sealed prior to placement within said cavity, said spacer member completely covering the top of said tube, said spacer member having on its top outer surface a frustoconical area facing the interior wall of said cavity, said frustoconical area and said wall form a V-shape cross-sectional channel, said spacer having a bottom outer surface which rests on a shoulder within said cavity;

an annular sealing member placed over said spacer member and having an interior frustoconical surface and an outer cylindrical side surface, said annular sealing member being positioned in said V-shaped channel; and a plug member threadably engaged within said cavity over and in contact with said annular sealing member, said plug when being moved toward said tube causing said annular sealing member to be wedged within said V-shape channel to establish a secondary seal over said tube, so that, if any fluid would escape from said sealed tube, said annular sealing member will prevent any fluid escaping said rotor.

2. A centrifuge rotor sealing arrangement as defined in claim 1, wherein said annular sealing member comprises an elastomeric material.

3. A centrifuge rotor sealing arrangement as defined in claim 1, wherein said annular sealing member is attached to said plug member.

4. A centrifuge rotor sealing arrangement as defined in claim 3, wherein the portion of said annular sealing member projecting from the bottom of said plug member is deeper than the depth of said V-shaped channel so that said annular sealing member will be compressed with said V-shaped channel and provide a tight seal to prevent potential fluid escape from said rotor.

5. A centrifuge rotor sealing arrangement as defined in claim 1, wherein the bottom surface of said spacer member being shaped to receive in face to face contact the upper portion of said tube so that said upper spacer member in conjunction with said tube cavity provides complete exterior support to said tube during centrifugation.

6. A tube containment seal arrangement for a centrifuge rotor comprising:

a rotor having at least one cavity for receipt of a centrifuge tube;

a ledge within said cavity formed by a counterbore area;

a space mounted adjacent said tube and in contact with said ledge, said spacer having adjacent its upper surface an inclined surface in a downward and outward direction from said upper surface;

a retaining plug positioned above said tube and said spacer to secure said tube during centrifugation; and a sealing washer mounted between said spacer and said plug along the wall of said counterbore area, said washer having a depending internal frustoconical surface for mating with said inclined surface of said spacer, said washer having an outside cylindrical surface to mate with the cylindrical interior wall of said counterbore area, movement of said plug toward said spacer causing said frustoconical surface washer to be tightly wedged between said spacer inclined surface and said wall of said counterbore to block and reduce any propagation of fluid from said tube to the exterior of said rotor during centrifugation.

* * * * *